US011365082B2

(12) United States Patent
Okada et al.

(10) Patent No.: US 11,365,082 B2
(45) Date of Patent: Jun. 21, 2022

(54) POST-PROCESSING APPARATUS

(71) Applicant: KYOCERA Document Solutions Inc., Osaka (JP)

(72) Inventors: Rina Okada, Osaka (JP); Terumitsu Noso, Osaka (JP); Yasunori Ueno, Osaka (JP)

(73) Assignee: KYOCERA Document Solutions Inc.

( * ) Notice: Subject to any disclaimer, the term of this patent is extended or adjusted under 35 U.S.C. 154(b) by 751 days.

(21) Appl. No.: 16/371,231

(22) Filed: Apr. 1, 2019

(65) Prior Publication Data

US 2019/0225450 A1 Jul. 25, 2019

Related U.S. Application Data

(62) Division of application No. 15/945,156, filed on Apr. 4, 2018, now Pat. No. 10,287,127.

(30) Foreign Application Priority Data

Apr. 20, 2017 (JP) ..... JP2017-083938

(51) Int. Cl.
*B65H 31/26* (2006.01)
*B65H 29/46* (2006.01)
(Continued)

(52) U.S. Cl.
CPC ..... *B65H 31/26* (2013.01); *B65H 29/246* (2013.01); *B65H 29/46* (2013.01); *B65H 29/50* (2013.01);
(Continued)

(58) Field of Classification Search
CPC ..... B65H 29/246; B65H 29/46; B65H 29/50; B65H 2511/20; B65H 2553/612;
(Continued)

(56) References Cited

U.S. PATENT DOCUMENTS 6,142,469 A 11/2000 Nanba et al.
6,390,466 B1 5/2002 Sanmiya
(Continued)

FOREIGN PATENT DOCUMENTS

JP 2002-87685 3/2002

OTHER PUBLICATIONS

Information Disclosure Statement of Apr. 4, 2018.
Notice of Allowability dated Jan. 25, 2019.

*Primary Examiner* — Leslie A Nicholson, III
(74) *Attorney, Agent, or Firm* — Gerald E. Hespos; Michael J. Porco

(57) ABSTRACT

The present application discloses a post-processing apparatus including a second tray which receives a sheet stack ejected from a first tray, a pushing mechanism including a pushing portion which pushes the sheet stack against the second tray, a motion detector which detects a motion of the pushing mechanism, and a controller including an ejection controller which controls an ejector. When the ejector ejects the sheet stack, the pushing mechanism moves the pushing portion in a first direction away from the second tray. When the ejector finishes ejection of the sheet stack, the pushing mechanism moves the pushing portion in a second direction which is opposite to the first direction. Unless the motion detector detects the motion of the pushing mechanism moving the pushing portion in the first direction when the ejector ejects the sheet stack, the ejection controller executes interruption control of stopping the ejection of the sheet stack.

3 Claims, 7 Drawing Sheets

(51) Int. Cl.

| | |
|---|---|
| ***B65H 43/00*** | (2006.01) |
| ***B65H 29/24*** | (2006.01) |
| ***B65H 29/50*** | (2006.01) |
| ***B65H 31/30*** | (2006.01) |
| ***B65H 37/04*** | (2006.01) |
| ***B65H 43/06*** | (2006.01) |
| ***B65H 31/10*** | (2006.01) |

(52) U.S. Cl.
CPC ..... *B65H 31/10* (2013.01); *B65H 31/3027* (2013.01); *B65H 31/3081* (2013.01); *B65H 37/04* (2013.01); *B65H 43/00* (2013.01); *B65H 43/06* (2013.01); *B65H 2301/4223* (2013.01); *B65H 2301/42266* (2013.01); *B65H 2404/73* (2013.01); *B65H 2511/20* (2013.01); *B65H 2513/512* (2013.01); *B65H 2513/53* (2013.01); *B65H 2515/702* (2013.01); *B65H 2553/612* (2013.01); *B65H 2801/27* (2013.01)

(58) Field of Classification Search
CPC ..... B65H 2515/702; B65H 2513/512; B65H 2513/53; B65H 2404/73; B65H 2801/27; B65H 2301/4223; B65H 2301/42262; B65H 2301/42; B65H 43/02; B65H 43/06; B65H 31/26; B65H 31/3027; B65H 31/3081; B65H 31/3054; B65H 31/3063; B65H 31/02; B65H 31/08; B65H 31/10; B65H 31/12
See application file for complete search history.

(56) References Cited

U.S. PATENT DOCUMENTS

| | | | | |
|---|---|---|---|---|
| 6,412,774 | B1 | 7/2002 | Saito et al. | |
| 6,634,641 | B2 * | 10/2003 | Yamakawa | B65H 43/00 271/220 |
| 7,416,177 | B2 * | 8/2008 | Suzuki | B65H 45/18 270/32 |
| 7,661,669 | B2 * | 2/2010 | Ichihashi | B65H 31/3027 270/58.09 |
| 8,123,209 | B2 * | 2/2012 | Kubota | G03G 15/6541 270/58.08 |
| 8,146,909 | B2 | 4/2012 | Kuno | |
| 8,678,368 | B2 | 3/2014 | Yoshida | |
| 8,770,570 | B2 * | 7/2014 | Soga | B65H 37/04 270/58.11 |
| 8,870,175 | B2 | 10/2014 | Gamo | |
| 8,915,492 | B2 | 12/2014 | Sugiyama et al. | |
| 8,936,240 | B2 | 1/2015 | Hoshino et al. | |
| 9,891,571 | B2 | 2/2018 | Sato et al. | |
| 10,046,940 | B2 * | 8/2018 | Obuchi | B65H 31/3081 |
| 2018/0290852 | A1 | 10/2018 | Okada et al. | |
| 2018/0312361 | A1 | 11/2018 | Iwamoto | |

* cited by examiner

POST-PROCESSING APPARATUS

CROSS-REFERENCE TO RELATED APPLICATIONS

This application is a divisional of U.S. patent application Ser. No. 15/945,156, filed on Apr. 4, 2018.

BACKGROUND

The present disclosure relates to a post-processing apparatus which performs a predetermined process after an image forming process performed by an image forming apparatus.

It is known to eject sheets onto a tray which has a support surface formed between a proximal end and a distal end distant in the ejection direction from the proximal end of the sheets, the distal end being situated at a higher position than the proximal end. A pushing portion configured to push the upstream end of a sheet on the tray may be incorporated into an image forming apparatus because the sheet may slide down toward the proximal end.

SUMMARY

The post-processing apparatus according to the present disclosure performs a predetermined process after an image forming process performed by an image forming apparatus. The post-processing apparatus includes a first tray which temporarily holds a sheet stack formed from stacked sheets; an ejector which sends the sheet stack from the first tray in an ejection direction to eject the sheet stack from the first tray; a second tray configured to receive the sheet stack ejected from the first tray by a sloped surface which extends from a proximal end to a distal end that is distant from the proximal end in the ejection direction and situated at a higher position than the proximal end; a pushing mechanism including a pushing portion configured to push an upstream end in the ejection direction of the sheet stack against the second tray; a motion detector configured to detect a motion of the pushing mechanism; and a controller including an ejection controller configured to control the ejector. The pushing mechanism moves the pushing portion in a first direction away from the second tray when the ejector ejects the sheet stack from the first tray to the second tray under control by the ejection controller. The pushing mechanism moves the pushing portion in a second direction which is opposite to the first direction when the ejector finishes ejection of the sheet stack from the first tray to the second tray under control of the ejection controller. The ejection controller executes interruption control of interrupting the ejection of the sheet stack unless the motion detector detects the motion of the pushing mechanism moving the pushing portion in the first direction when the ejector ejects the sheet stack from the first tray to the second tray under control of the ejection controller.

DETAILED DESCRIPTION

Figure 1:
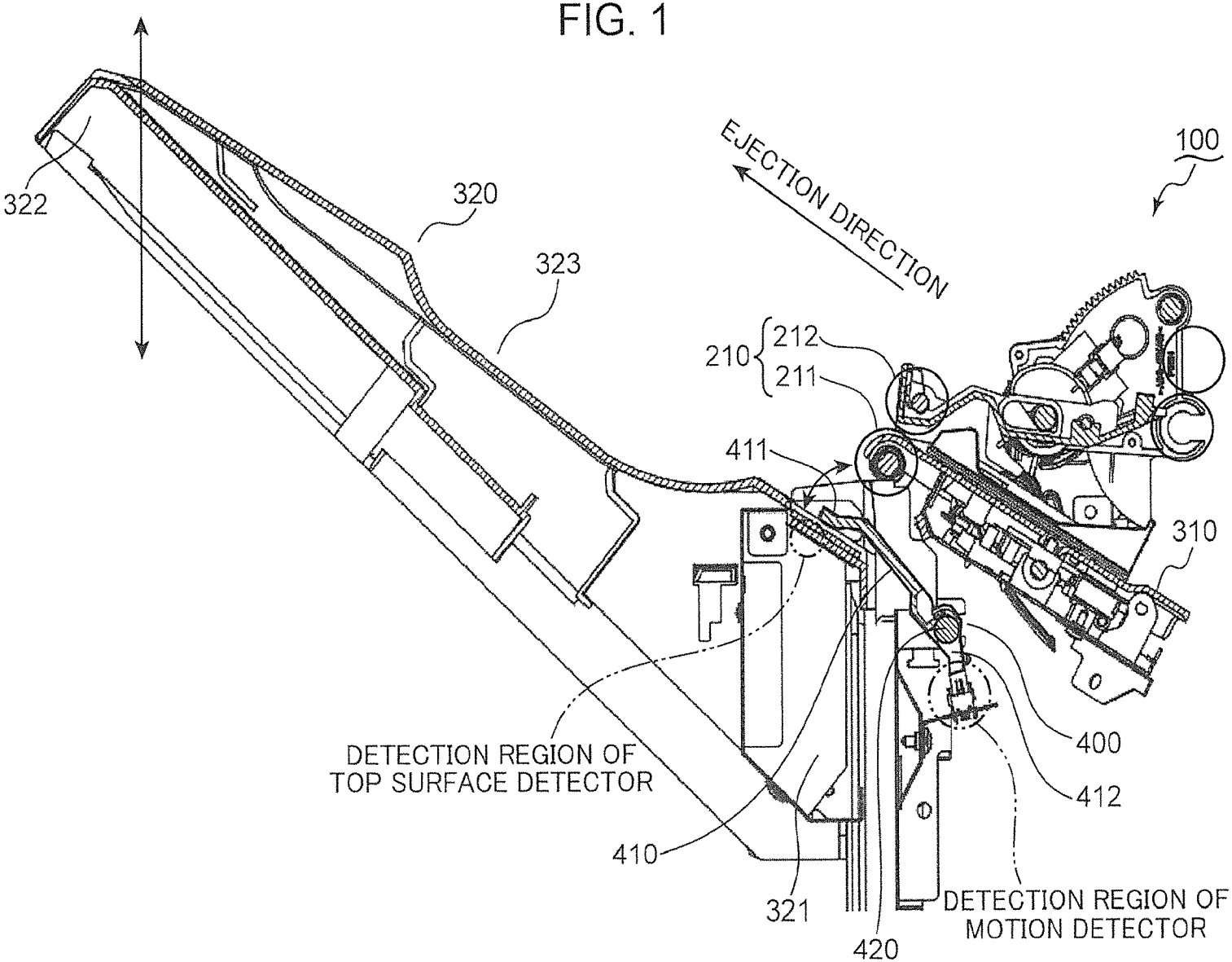
FIG. 1 is a schematic cross-sectional view of a part of an exemplary post-processing apparatus.

FIG. 1 is a schematic cross-sectional view showing a part of an exemplary post-processing apparatus 100. The post-processing apparatus 100 is described with reference to FIG. 1.

An image forming apparatus (not shown) forms an image on a sheet (not shown) (image forming process). The sheet is then sent from the image forming apparatus to the post-processing apparatus 100. For example, the post-processing apparatus 100 make holes on the sheet, staples the sheet or folds the sheet. The principles of the present embodiment are not limited to a particular process performed by the post-processing apparatus 100.

As shown in FIG. 1, the post-processing apparatus 100 includes an ejector 210, a first tray 310 situated upstream of the ejector 210 in the ejection direction, a second tray 320 situated downstream of the first tray 310 in the ejection direction and a pushing mechanism 400 situated upstream of the second tray 320 in the ejection direction. The post-processing apparatus 100 is designed to form a sheet stack on the first tray 310. Various sheet-conveying techniques used in known post-processing apparatuses are applicable to form the sheet stack on the first tray 310. The principles of the present embodiment are not limited to particular sheet conveyance techniques for forming the sheet stack on the first tray 310. The ejector 210 sends the sheet stack from the first tray 310 in the ejection direction. The second tray 320 situated downstream of the first tray 310 in the ejection direction receives the sheet stack sent by the ejector 210. The pushing mechanism 400 pushes the upstream end of the sheet stack on the second tray 320. Configurations of the first tray 310, the second tray 320, the ejector 210 and the pushing mechanism 400 are described below.

The sheet stack is temporarily held by the first tray 310. With regard to the present embodiment, sheets stacked on the first tray 310 are stapled and becomes a sheet stack. The ejector 210 situated at the downstream end of the first tray 310 then sends the sheet stack in the ejection direction. Consequently, the sheet stack is ejected from the first tray 310 to the second tray 320.

The second tray 320 includes a proximal end 321 situated at a lower position than the ejector 210, and a distal end 322 which is distant from the proximal end 321 in the ejection direction and positioned at a higher position than the proximal end 321. The second tray 320 has a sloped surface 323 extending from the proximal end 321 to the distal end 322. The sloped surface 323 receives the sheet stack ejected by the ejector 210 from the first tray 310. The sheet stack on the second tray 320 is then moved by the gravity toward the proximal end 321.

The ejector 210 configured to eject the sheet stack to the second tray 320 includes rollers 211, 212. The roller 211 is driven by a motor (not shown) to eject the sheet stack from the first tray 310. Meanwhile, the roller 212 above the roller 211 is pushed against the roller 211. Therefore, the sheet stack is sandwiched between the rollers 211, 212 so that a rotational force of the roller 211 is efficiently transmitted to the sheet stack. Accordingly, the sheet stack is smoothly ejected from the first tray 310 to the second tray 320.

The pushing mechanism 400 situated near the proximal end 321 of the second tray 320 includes a pusher arm 410 shaped in a bar and a rotary shaft 420 which supports the pusher arm 410. The pusher arm 410 and the rotary shaft 420 are positioned below the first tray 310 and at an upstream position in the ejection direction of the proximal end 321 of the second tray 320. The pusher arm 410 includes a pushing portion 411 which forms the distal end of the pusher arm 410 and a detection end 412 which is the proximal end of the pusher arm 410. The rotary shaft 420 is connected to the pusher arm 410 between the pushing portion 411 and the detection end 412. The pusher arm 410 swings about the rotary shaft 420 when the rotary shaft 420 rotates (c.f. the arrow near the proximal end 321 of the second tray 320 in FIG. 1).

The pushing portion 411 is situated in a gap between the roller 211 of the ejector 210 and the proximal end 321 of the second tray 320. The pushing portion 411 moves downward to push the upstream end in the ejection direction of the sheet stack against the sloped surface 323 of the second tray 320 when the rotary shaft 420 rotates.

The detection end 412 which is opposite to the pushing portion 411 is used for detecting the motion of the pushing mechanism 400. When the detection end 412 stays unmoved during the ejection of the sheet stack, the post-processing apparatus 100 is controlled to stop ejecting the sheet stack. The control performed for the post-processing apparatus 100 is described.

Figure 2:
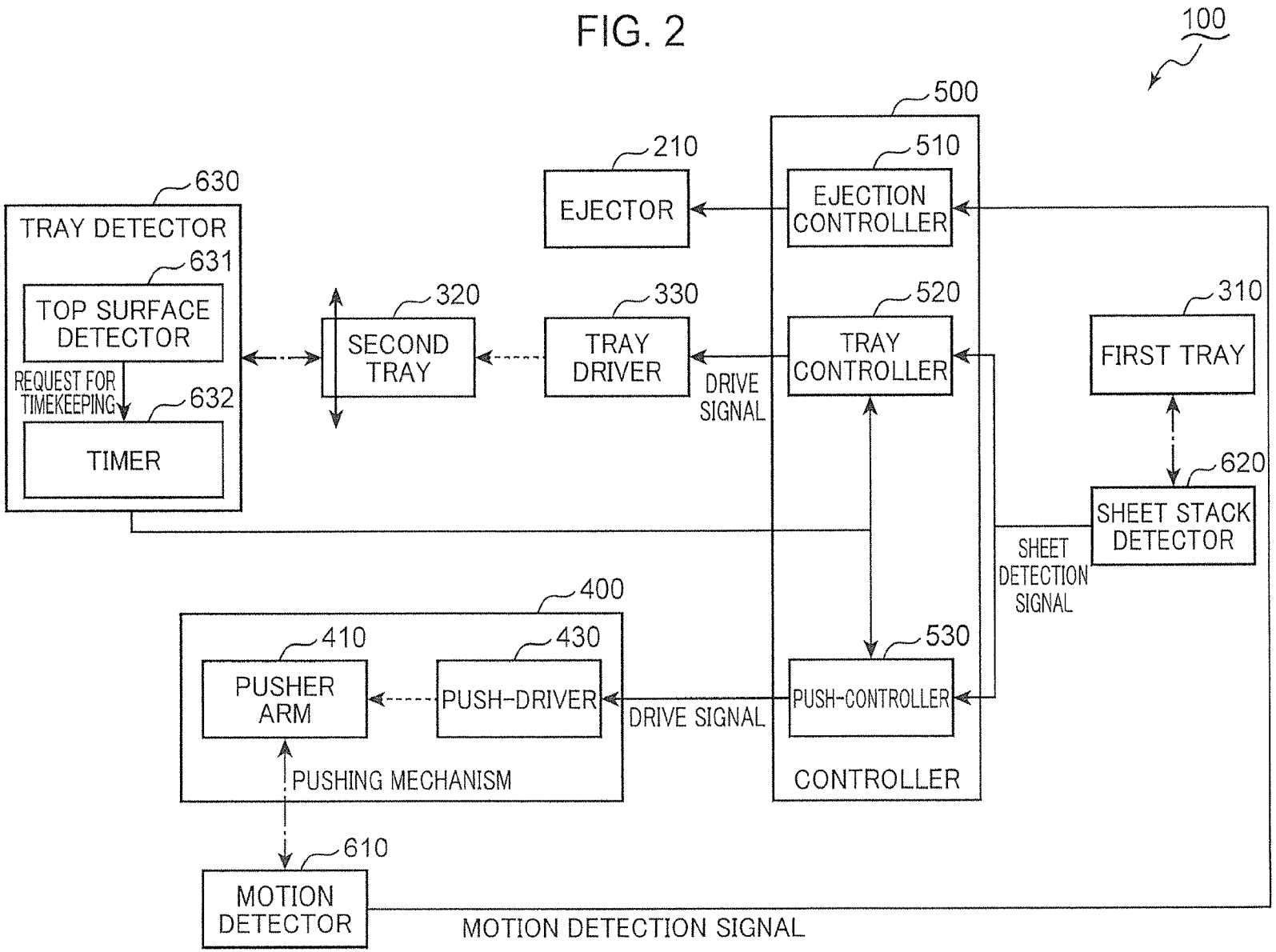
FIG. 2 is a schematic block diagram showing an exemplary functional configuration of the post-processing apparatus depicted in FIG. 1.

FIG. 2 is a schematic block diagram showing an exemplary functional configuration of the post-processing apparatus 100. The post-processing apparatus 100 is further described with reference to FIGS. 1 and 2. The solid line in FIG. 2 conceptually shows transmission of signals. The dotted line in FIG. 2 conceptually shows transmission of forces. The chain line in FIG. 2 conceptually shows a detecting motion.

The post-processing apparatus 100 further includes a tray driver 330, a controller 500, a motion detector 610, a sheet stack detector 620 and a tray detector 630. The motion detector 610 detects a motion of the pushing mechanism 400 and generates a signal representing the motion of the pushing mechanism 400. The sheet stack detector 620 detects the sheet stack on the first tray 310 and generates a signal representing whether there is the sheet stack on the first tray 310. The tray detector 630 detects the second tray 320 when there is the second tray 320 at a predetermined position. The tray detector 630 generates a signal representing whether there is the second tray 320 at the predetermined position. The controller 500 controls the tray driver 330 on the basis of the signals generated by the tray detector 630, the sheet stack detector 620 and the motion detector 610. The tray driver 330 is controlled by the controller 500 to move the second tray 320 up and down. The tray driver 330 may include a motor (not shown) and a transmission mechanism designed to convert a rotational force of the motor into a vertical movement of the second tray 320 (e.g. a combination of a belt which a pulley (not shown)). Alternatively, the tray driver 330 may include a cylinder device (not shown) connected to the second tray 320. The mechanism of the present embodiment is not limited to a particular mechanism of the tray driver 330.

The controller 500 controls not only the tray driver 330 but also the ejector 210 and the pushing mechanism 400. In short, the controller 500 includes an ejection controller 510, which controls the ejector 210, a tray controller 520, which controls the tray driver 330, and a push-controller 530, which controls the pushing mechanism 400. The ejection controller 510 may control the ejector 210 to eject the sheet stack from the first tray 310 to the second tray 320 in response to completion of stapling the sheet stack on the first tray 310. The principles of the present embodiment are not limited to a particular timing of starting the ejection of the sheet stack. After the ejector 210 starts ejecting the sheet stack from the first tray 310 to the second tray under control of the ejection controller 510, the tray controller 520 and the push-controller 530 may control the tray driver 330 and the pushing mechanism 400.

The start timing of the control for the tray driver 330 and the pushing mechanism 400 is determined by a signal output from the sheet stack detector 620 (hereinafter referred to as "sheet detection signal"). The sheet stack detector 620 may be a reflection type optical sensor attached to the first tray 310. When there is no sheet stack on the first tray 310, the sheet stack detector 620 generates a sheet detection signal at a low voltage. When there is a sheet stack on the first tray 310, the sheet stack detector 620 receives detection light reflected on a bottom surface of the sheet stack and generates a sheet detection signal at a high voltage. The detection light may be emitted to the upstream end in the ejection direction of the sheet stack. The sheet detection signal changes from the high voltage to the low voltage as soon as the ejector 210 ejects the sheet stack from the first tray 310 to the second tray 320 under control of the ejection controller 510. The sheet detection signal is output from the sheet stack detector 620 to the tray controller 520 and the push-controller 530.

The tray controller 520 controls the tray driver 330 in response to the sheet detection signal. When the sheet stack is ejected from the first tray 310 to the second tray 320, the sheet detection signal changes from the high voltage to the low voltage as described above. In response to the sheet detection signal changing from high voltage to low voltage, the tray controller 520 generates a drive signal for moving the second tray 320 down. The drive signal is output from the tray controller 520 to the tray driver 330. The tray driver 330 moves the second tray 320 down in response to the drive signal. As a result of the second tray 320 moving down, there is a large vertical gap between the second tray 320 and the ejector 210. Accordingly, even when a thick sheet stack is ejected to the second tray 320 or even when sheet stacks are stacked on the second tray 320, the next sheet stack may drop onto the second tray 320.

The tray detector 630 for detecting the second tray 320 includes a top surface detector 631 and a timer 632. The top surface detector 631 may be a reflective type optical sensor. The top surface detector 631 detects the top surface of the sheet stack on the second tray 320. A voltage of the tray detection signal which the top surface detector 631 is different between when the top surface detector 631 detects the top surface of the sheet stack and when the top surface detector 631 does not detect the top surface of the sheet stack. With regard to the present embodiment, the top surface detector 631 outputs a tray detection signal at a high voltage in a detected state in which the top surface detector 631 detects the top surface of the sheet stack. On the other hand, the top surface detector 631 outputs a detection signal at a low voltage in a non-detected state in which the top surface detector 631 does not detect the top surface of the sheet stack. When a change from the high voltage to the low voltage happens to the detection signal, the top surface detector 631 requests the timer 632 to start timekeeping. The timer 632 starts timekeeping in response to the instruction by the top surface detector 631. It is continued to move the second tray 320 down until a time period elapsed after the start of timekeeping becomes a predetermined time length. In short, the tray controller 520 keeps generating a drive signal for moving the second tray 320 down.

When a timekeeping value of the timer 632 (i.e. the elapsed time) becomes a predetermined value, the tray controller 520 generates a drive signal for moving the second tray 320 up. The drive signal is output from the tray controller 520 to the tray driver 330. The tray driver 330 moves the second tray 320 up in response to the drive signal.

When the second tray 320 is moved up under control of the tray controller 520, the second tray 320 or the top surface of the sheet stack on the second tray 320 enters a detection region defined by the top surface detector 631. FIG. 1 conceptually shows the detection region defined by the top surface detector 631.

When the second tray 320 or the top surface of the sheet stack on the second tray 320 enters the detection region of the top surface detector 631, the top surface detector 631 receives detection light reflected on the second tray 320 or the top surface of the sheet stack. Consequently, the tray detection signal generated by the top surface detector 631 changes from the low voltage to the high voltage. The tray detection signal is output from the top surface detector 631 to the tray controller 520. In response to the change from the low voltage to the high voltage of the tray detection signal generated by the top surface detector 631, the tray controller 520 stops generating the drive signal. Accordingly, the second tray 320 stops.

The moving direction of the second tray 320 changes from the downward movement to the upward movement when the timekeeping value which the timer 632 records (i.e. the elapsed time) becomes the predetermined value. The push-controller 530 generates a drive signal for driving the pushing mechanism 400 substantially in synchronization with the change in the moving direction of the second tray 320.

The pushing mechanism 400 which is operated under control of the push-controller 530 includes not only the pusher arm 410 and the rotary shaft 420 but also a push-driver 430. The push-driver 430 may be a solenoid switch designed to bi-directionally rotate the rotary shaft 420. Alternatively, the push-driver 430 may be a stepping motor connected to the rotary shaft 420. The principles of the present embodiment are not limited to a particular driving device used as the push-driver 430. The push-driver 430 is controlled by the push-controller 530 in response to the timekeeping value, which the timer 632 records, and the sheet detection signal as described below.

When the sheet stack is ejected from the first tray 310 to the second tray 320, the sheet detection signal changes from the high voltage to the low voltage as described above. In response to the change from the high voltage to the low voltage of the sheet detection signal, the push-controller 530 generates a drive signal for driving the push-driver 430. The drive signal output from the push-controller 530 to the push-driver 430 in response to the change from the high voltage to the low voltage of the sheet detection signal gives an instruction to the pushing portion 411 to move in a first direction away from the proximal end 321 of the second tray 320 (i.e. the upward direction). In response to the drive signal, the push-driver 430 rotates the rotary shaft 420 to move the pushing portion 411 in the first direction. The movement of the pushing portion 411 in the first direction causes a gap between the pushing portion 411 and the proximal end 321 of the second tray 320 or the top surface of the sheet stack on the second tray 320. The sheet stack ejected by the ejector 210 then moves along the inclination of the sloped surface 323 in the direction in opposite to the ejection direction, so that the upstream end of the sheet stack enters the gap.

Like the push-controller 530, the tray controller 520 also receives the sheet detection signal from the sheet stack detector 620. In response to the change from the high voltage to the low voltage of the sheet detection signal, the tray controller 520 generates a drive signal for moving the second tray 320 down. The drive signal is output from the tray controller 520 to the tray driver 330. The tray driver 330 moves the second tray 320 down in response to the drive signal. Accordingly, the top surface of the sheet stack on the second tray 320 exits the detection region of the top surface detector 631, so that the detection signal of the top surface detector 631 changes from the high voltage (the detected state) to the low voltage (the non-detected state). In response to the voltage drop of the detection signal, the top surface detector 631 requests the timer 632 to start timekeeping. The timer 632 starts timekeeping in response to the timekeeping request given by the top surface detector 631. When the timekeeping value (i.e. the recorded time) becomes the predetermined value, the timer 632 notifies the tray controller 520 and the push-controller 530 that the timekeeping value becomes the predetermined value. In response to the notification given by the timer 632, the tray controller 520 generates a drive signal for moving the second tray 320 up while the push-controller 530 generates a drive signal for moving the pushing portion 411 in the second direction (i.e. the downward direction) which is opposite to the first direction. Since the pushing portion 411 moves in the second direction in response to the drive signal from the push-controller 530, the upstream end of the sheet stack is sandwiched between the pushing portion 411 and the second tray 320 or another sheet stack stacked on the second tray 320. Therefore, the sheet stack is stopped on the second tray 320.

The detection end 412 of the pusher arm 410 is displaced while the pushing portion 411 moves upward or downward. The displacement of the detection end 412 is detected by the motion detector 610. FIG. 1 conceptually shows the detection region defined by the motion detector 610. The detection region is defined on a moving path of the detection end 412 of the pusher arm 410. The motion detector 610 may be a reflective type optical sensor. The optical sensor used as the motion detector 610 may be situated so as to receive light reflected on the detection end 412 when the pushing portion 411 is at the uppermost position of the movable range of the pushing portion 411. Alternatively, the optical sensor used as the motion detector 610 may be situated so as to receive light reflected on the detection end 412 when the pushing portion 411 is at the lowermost position of the movable range of the pushing portion 411. The voltage of the motion detection signal generated by the motion detector 610 depends on whether the reflection light is received or not.

When the pusher arm 410 operates normally, a change in voltage happens to the motion detection signal immediately after the start of ejecting the sheet stack from the first tray 310 to the second tray 320. When a sheet stack is placed over the pushing portion 411, the sheet stack prevents the rotary shaft from swinging about the rotary shaft 420, so that the voltage of the motion detection signal is kept almost constant after the ejection of the sheet stack from the first tray 310 to the second tray 320.

The motion detection signal is output from the motion detector 610 to the ejection controller 510. Unless the ejection controller 510 finds the change in voltage of the motion detection signal within a predetermined time period after the ejection controller 510 starts ejecting the sheet stack from the first tray 310 to the second tray 320, the ejection controller 510 executes interruption control of stopping the ejection of the sheet stack. Otherwise, the ejection controller 510 continues the ejection of the sheet stack from the first tray 310 to the second tray 320.

Figure 3:
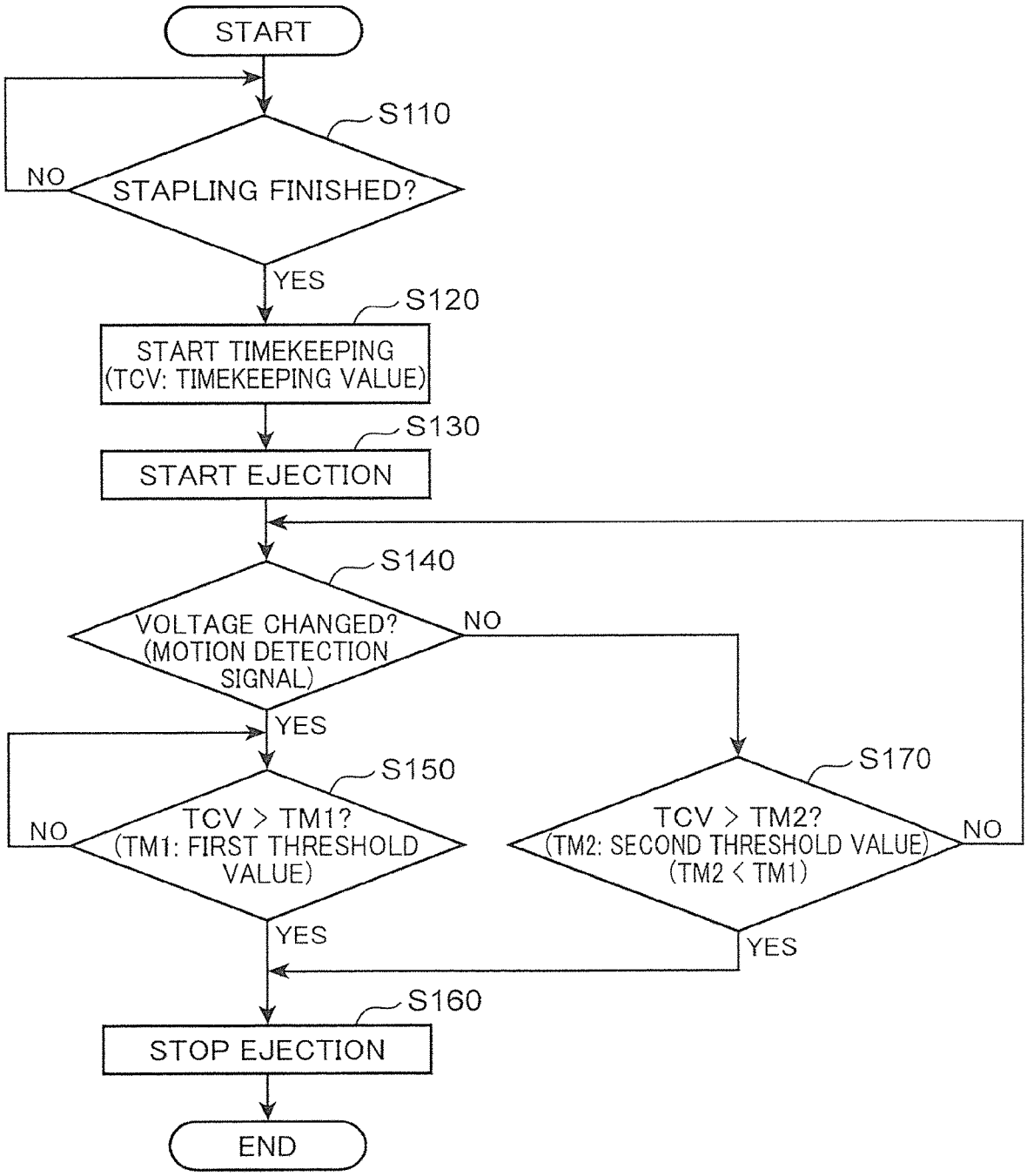
FIG. 3 is a schematic flowchart showing an exemplary process performed by an ejection controller of the post-processing apparatus depicted in FIG. 2.

FIG. 3 is a schematic flowchart showing an exemplary process performed by the ejection controller 510. The process performed by the ejection controller 510 is described with reference to FIGS. 1 to 3.

(Step S110)

The ejection controller 510 waits for completion of stapling (not shown). After the stapler staples the sheet stack on the first tray 310, step S120 is executed.

(Step S120)

The ejection controller 510 starts timekeeping. The timekeeping value increases from "zero". After starting the timekeeping, step S130 is executed.

(Step S130)

The ejection controller 510 moves the roller 212 downward. Consequently, the sheet stack on the first tray 310 is sandwiched between the rollers 211, 212. The ejection controller 510 drives the roller 211. The rotation of the roller 211 is transmitted to the sheet stack so that the sheet stack is sent in the ejection direction. In short, the ejection of the sheet stack starts. After the start of ejecting the sheet stack from the first tray 310 to the second tray 320, step S140 is executed.

(Step S140)

The ejection controller 510 confirms whether there is a change in voltage of the motion detection signal. If there is the change in voltage of the motion detection signal, step S150 is executed. Otherwise, step S170 is executed.

(Step S150)

The ejection controller 510 compares the timekeeping value with a first threshold value. The first threshold value is determined so that the sheet stack passes through the ejector 210 when the ejector 210 sends the sheet stack on the first tray 310 in the ejection direction for a time period determined by the first threshold value. Step S150 is executed until the timekeeping value exceeds the first threshold value. Since the sheet stack passes through the ejector 210 when the timekeeping value exceeds the first threshold value, the ejector 210 finishes the ejection of the sheet stack. When the timekeeping value exceeds the first threshold value, step S160 is executed.

(Step S160)

The ejection controller 510 stops driving the roller 211 (performs interruption control). The interruption control prevents troubles in the ejection caused by a sheet stack being placed over the pusher.

(Step S170)

The ejection controller 510 compares the timekeeping value with a second threshold value. The second threshold value is smaller than the first threshold value. The second threshold value is determined so that the sheet stack is sandwiched between the rollers 211, 212 until the timekeeping value becomes the second threshold value while the ejector 210 sends the sheet stack in the ejection direction. When the timekeeping value exceeds the second threshold value, step S160 is executed. In this case, the sheet stack stops before the sheet stack is completely ejected from the ejector 210. If the timekeeping value does not exceed the second threshold value, step S140 is executed.

Figure 4:
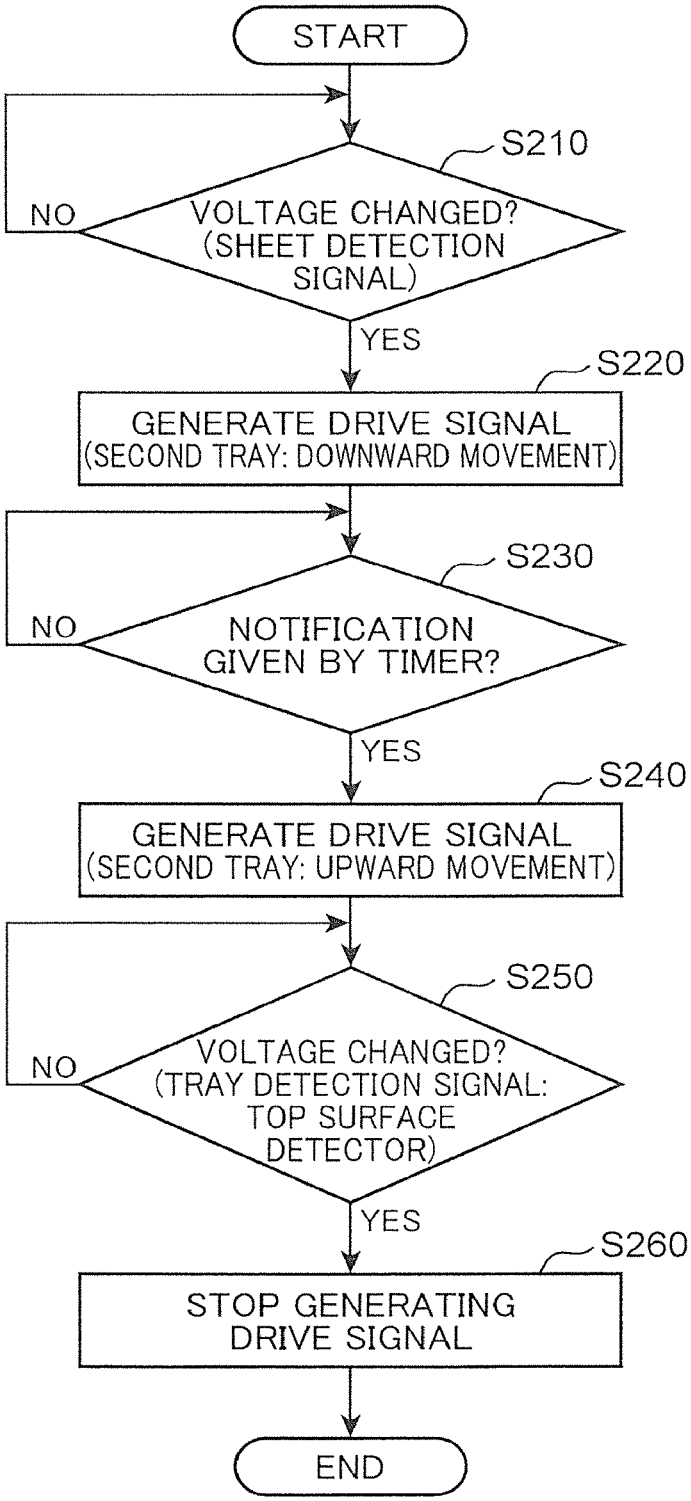
FIG. 4 is a schematic flowchart showing an exemplary process performed by a tray controller of the post-processing apparatus depicted in FIG. 2.

FIG. 4 is a schematic flowchart showing an exemplary process performed by the tray controller 520 to control the second tray 320 after the ejection controller 510 starts ejecting a sheet stack. The process performed by the tray controller 520 is described with reference to FIGS. 1, 2 and 4.

(Step S210)

The tray controller 520 waits for a change in the voltage of the sheet detection signal. As described above, the change in the voltage of the sheet detection signal means a start of the ejection of the sheet stack from the first tray 310. When there is the change in voltage of the sheet detection signal, step S220 is executed.

(Step S220)

The tray controller 520 generates a drive signal which instructs a downward movement of the second tray 320. The drive signal is output from the tray controller 520 to the tray driver 330. The tray driver 330 moves the second tray 320 down in response to the drive signal. Then, step S230 is executed.

(Step S230)

The tray controller 520 waits for the notification by the timer 632 (the notification which notifies that the timekeeping value becomes a predetermined value). As described above, step S240 is executed after the notification from the timer 632.

(Step S240)

The tray controller 520 generates a drive signal which instructs an upward movement of the second tray 320. The drive signal is output from the tray controller 520 to the tray driver 330. The tray driver 330 moves the second tray 320 up in response to the drive signal. Then, step S250 is executed.

(Step S250)

The tray controller 520 waits for a change in voltage of the tray detection signal output from the top surface detector 631. As described above, the change in voltage of the tray detection signal output from the top surface detector 631 means that the second tray 320 or the top surface of the sheet stack on the second tray 320 has entered the detection region which is defined by the top surface detector 631 (c.f. FIG. 1). When there is the change in voltage of the tray detection signal output from the top surface detector 631, step S260 is executed.

(Step S260)

The tray controller 520 stops generating the drive signal. Accordingly, the tray driver 330 and the second tray 320 stop.

Figure 5:
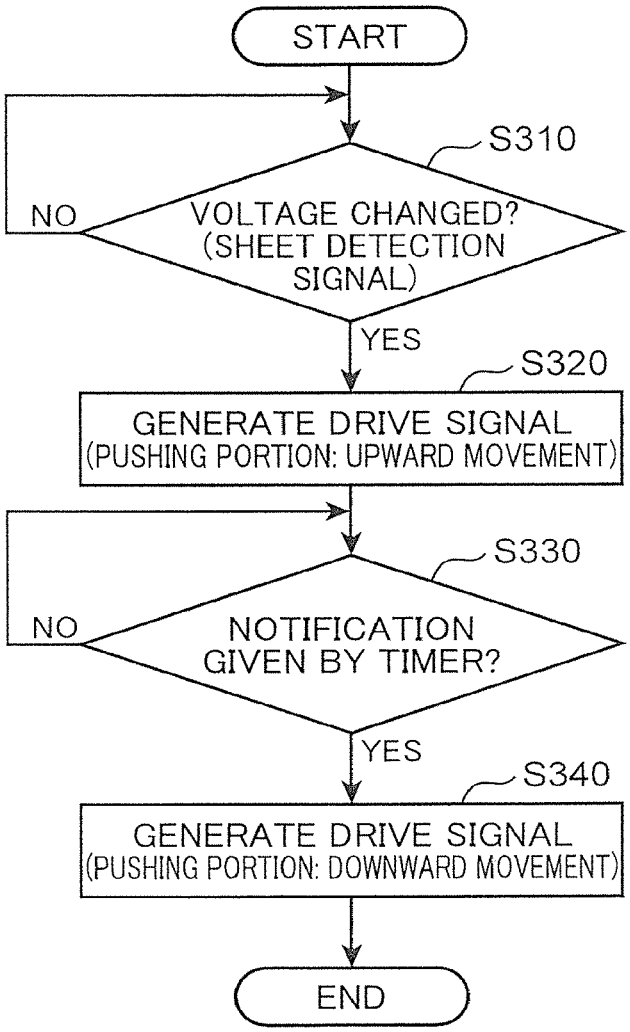
FIG. 5 is a schematic flowchart showing an exemplary process performed by a push-controller of the post-processing apparatus depicted in FIG. 2.

Like the tray controller 520, the push-controller 530 also controls the motion of the pusher arm 410 in response to the sheet detection signal. FIG. 5 is a schematic flowchart showing an exemplary process performed by the push-controller 530. The process performed by the push-controller 530 is described with reference to FIGS. 1 to 3 and 5.

(Step S310)

The push-controller 530 waits for the change in voltage of the sheet detection signal. As described above, the change in voltage of the sheet detection signal means the start of the ejection of the sheet stack from the first tray 310. When there is the change in voltage of the sheet detection signal, step S320 is executed.

(Step S320)

The push-controller 530 generates a drive signal which instructs an upward movement of the pushing portion 411. In response to the drive signal, the push-driver 430 rotates the rotary shaft 420 to move the pushing portion 411 up. Accordingly, a gap is created below the pushing portion 411. The upstream end of the sheet stack ejected from the first tray 310 to the second tray 320 may enter the gap below the pushing portion 411

The upward movement of the pushing portion 411 causes a change in voltage of the motion detection signal from the motion detector 610. In this case, step S150 which is described with reference to FIG. 3 is executed. On the other hand, if a sheet stack is incidentally placed over the pushing portion 411, the sheet stack prevents the pushing portion 411 from moving upward. Accordingly, there is no change in voltage of the motion detection signal while step S320 is executed. In this case, the processing loop from steps S140 to S170 which are described with reference to FIG. 3 is repeated. After the generation of the drive signal, step S330 is executed.

(Step S330)

The push-controller 530 waits for the notification by the timer 632 (the notification that notifies the timekeeping value becomes a predetermined value). Step S340 is executed after the notification by the timer 632.

(Step S340)

The push-controller 530 generates a drive signal which instructs a downward movement of the pushing portion 411. In response to the drive signal, the push-driver 430 rotates the rotary shaft 420 to move the pushing portion 411 down. Accordingly, the pushing portion 411 comes in contact with the upstream end of the sheet stack on the second tray 320.

<Other Features>

A designer may add various features to the aforementioned post-processing apparatus 100. The following features do not limit the principles of the post-processing apparatus 100 described in the context of the aforementioned embodiment.

Figure 6:
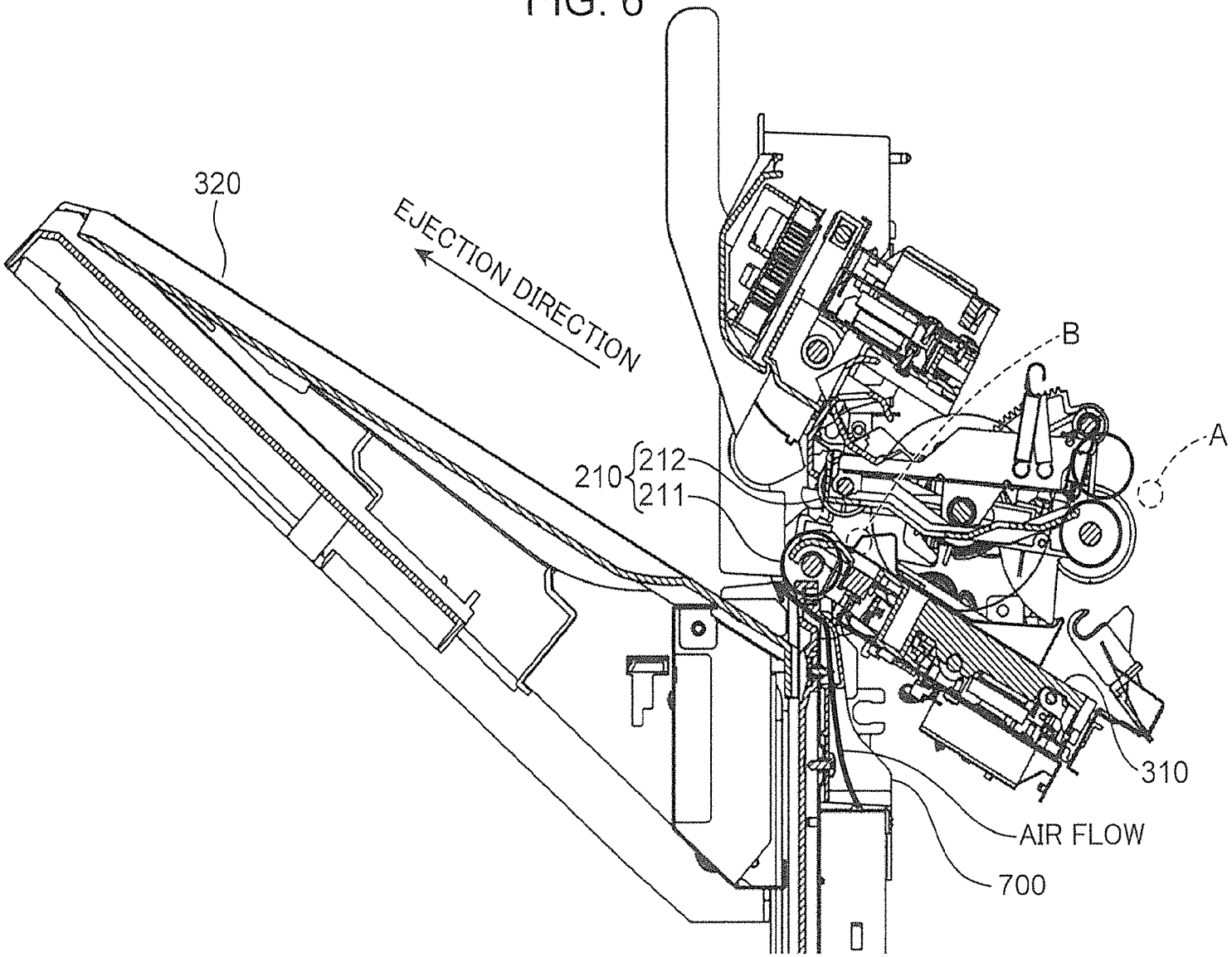
FIG. 6 is a schematic cross-sectional view of a part of the post-processing apparatus depicted in FIG. 1.

FIG. 6 is a schematic cross-sectional view of a part of the post-processing apparatus 100. The post-processing apparatus 100 is described with reference to FIG. 6.

The post-processing apparatus 100 further includes a blower 700. The blower 700 is situated below the first tray 310 and upstream of the second tray 320 in the ejection direction. The blower 700 blows air to a space above the second tray 320 through the gap between the roller 211 of the ejector 210 and the proximal end 321 of the second tray 320 when the sheet stack is ejected from the first tray 310 to the second tray 320. Accordingly, air flow is generated between the sloped surface 323 of the second tray 320 and the bottom surface of the sheet stack ejected from the first tray 310. The air flow significantly reduces friction between the second tray 320 and the sheet stack, so that the sheet stack is smoothly ejected from the first tray 310 to the second tray 320.

Figure 7:
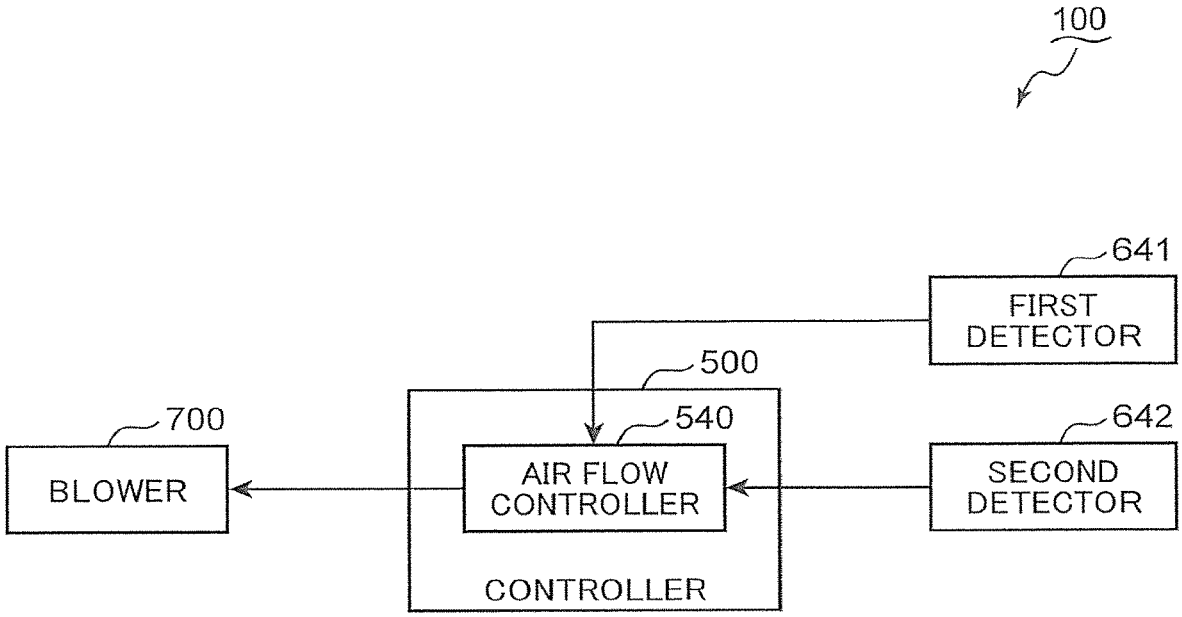
FIG. 7 is a schematic block diagram showing an exemplary functional configuration of the post-processing apparatus depicted in FIG. 6.

FIG. 7 is a schematic block diagram showing an exemplary functional configuration of the post-processing apparatus 100 having a function of generating the air flow. The post-processing apparatus 100 is described with reference to FIGS. 6 and 7.

As shown in FIG. 7, the post-processing apparatus 100 includes a first detector 641 and a second detector 642 as a part for controlling the blower 700. A detection region of the first detector 641 is shown in FIG. 6 with the dotted line circle as "region A". A detection region of the second detector 642 is shown in FIG. 6 with the dotted line circle as "region B". The region B is defined at the downstream end of the first tray 310 whereas the region A is defined on the conveyance path along which a sheet is conveyed toward the ejector 210. Therefore, the first detector 641 which uses the region A as the detection region detects a sheet conveyed toward the ejector 210 whereas the second detector 642 which uses the region B as the detection region detects a sheet stack on the first tray 310. A reflecting type or transmissive type optical sensor may be suitably used as the first and second detectors 641, 642. However, the principles of the present embodiment are not limited to a specific type of a sensor device used as the first and second detectors 641, 642.

With regard to the present embodiment, the first and second detectors 641, 642 are designed to output a high voltage signal when there is a sheet in the region A or B whereas the first and second detectors 641, 642 output a low voltage signal when there is no sheet in the region A or B. The first and second detectors 641, 642, however, may be designed to output a low voltage signal when there is a sheet in the region A or B whereas the first and second detectors 641, 642 output a high voltage signal when there is no sheet in the region A or B.

A change from the low voltage to the high voltage of the signal output from the first detector 641 means that a sheet has entered the region A. A change from the high voltage to the low voltage of the signal output from the first detector 641 means that a sheet has passed through the region A. A change from the low voltage to the high voltage of a signal output from the second detector 642, which is used for controlling the blower 700 together with the first detector 641, means that the first sheet of a sheet stack has been sent to the first tray 310. A change from the high voltage to the low voltage of the signal output from the second detector 642 means that a sheet stack has been ejected from the first tray 310.

The signals generated by the second and first detectors 642, 641 are output to the controller 500. The controller 500 includes a blower controller 540 which controls the blower 700 on the basis of the signals. The blower controller 540 actuates the blower 700 when the signal from the first detector 641 is a high voltage. The blower 700 may be actuated in synchronization with a clock time at which there is a change in signal of the first detector from the low voltage to the high voltage or the actuation timing of the blower 700 may be later than the changing clock time. The actuation timing of the blower 700 may be adjusted on the basis of a position of the region A (i.e. a position of the first detector 641).

A timing of stopping the blower 700 is determined in response to the signal from the second detector 642. When the signal from the second detector 642 changes from the high voltage to the low voltage, the blower controller 540 stops the blower 700. Consequently, a time period from the clock time at which the first sheet of the sheet stack is conveyed to the first tray 310 to the clock time at which the sheet stack is ejected from the first tray 310 to the second tray 320 is determined as an air-blow period during which the blower 700 blows air. After the sheet stack is ejected from the first tray 310 to the second tray 320, the air-blow from the blower 700 is stopped, so that the blower 700 does not waste power.

The blower controller 540 may control the blower 700 to operate intermittently during the aforementioned time period (i.e. the time period from the clock time at which the first sheet of the sheet stack is conveyed to the first tray 310 to the clock time at which the sheet stack is ejected from the first tray 310 to the second tray 320). In this case, the blower controller 540 may operate or stop the blower 700 on the basis of the signal from the first detector 641 or the time-keeping value of the timer (not shown). For example, the blower controller 540 may set a predetermined operating time, during which the blower 700 operates, or a predetermined downtime, during which the blower 700 is stopped, within the aforementioned time period. By setting the operating time and the downtime so that they repeat one after the other, the blower 700 operates intermittently.

It is preferable that the blower controller 540 actuates the blower 700 in synchronization with the start of the ejection of the sheet stack when the ejector 210 starts ejecting a sheet stack from the first tray 310 to the second tray 320 in the downtime. Consequently, the blower 700 causes air-flow between the top surface of the second tray 320 and the bottom surface of the sheet stack sent toward the second tray 320, so that there is effectively reduced friction between the top surface of the second tray 320 and the bottom surface of the sheet stack.

A typical fan-device may be used as the blower 700 for causing the air flow. For example, an axial fan, a centrifugal fan, a diagonal flow fan or a cross flow fan may be used as the blower 700. The principles of the present embodiment are not limited to a particular blower used for the blower 700.

With regard to the present embodiment, the pushing mechanism 400 operates under control by the controller 500. Alternatively, the pushing mechanism 400 may include a cam mechanism that swings the pusher arm 410 in conjunction with the upward and downward movement of the second tray 320.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

The invention claimed is:

1. A post-processing apparatus configured to perform a predetermined process after an image forming process performed by an image forming apparatus and eject a sheet stack after the predetermined process, the post-processing apparatus comprising:

a tray onto which the sheet stack is ejected;

an ejector which sends the sheet stack in an ejection direction to eject the sheet stack;

a pushing mechanism including a pushing portion configured to push the sheet stack against the tray;

a motion detector configured to detect a motion of the pushing mechanism; and a controller including an ejection controller configured to control the ejector, wherein the pushing mechanism moves the pushing portion in a first direction away from the tray when the ejector ejects the sheet stack to the tray under control by the ejection controller, wherein the pushing mechanism moves the pushing portion in a second direction which is opposite to the first direction when the ejector finishes ejection of the sheet stack to the tray under control of the ejection controller, and wherein the ejection controller executes interruption control of interrupting the ejection of the sheet stack unless the motion detector detects the motion of the pushing mechanism moving the pushing portion in the first direction when the ejector ejects the sheet stack to the tray under control of the ejection controller.

2. The post-processing apparatus according to claim 1, further comprising:

a tray driver which moves the second tray up and down; and a top surface detector which detects a top surface of the sheet stack on the tray, wherein the controller includes a tray controller which controls the tray driver, wherein the tray driver moves the tray down under control of the tray controller when the ejection of the sheet stack starts, and wherein the pushing mechanism moves the pushing portion in the second direction, and then the tray driver moves the tray up under control of the tray controller until the top surface detector detects the top surface of the sheet stack once the ejection of the sheet stack is completed.

3. The post-processing apparatus according to claim 1, further comprising a blower which blows air to a space above the tray, wherein the controller includes a blower controller configured to control the blower, and wherein the blower blows the air between the tray and a bottom surface of the sheet stack under control of the blower controller once the ejection of the sheet stack starts.

* * * * *